US006139003A

United States Patent [19]

Michalik et al.

[11] Patent Number: 6,139,003

[45] Date of Patent: Oct. 31, 2000

[54] PROCESS AND DEVICE FOR PRODUCING MULTI-LAYERED NEWSPAPER PRODUCTS WITH A TABLOID SECTION

[75] Inventors: Horst Bernhard Michalik, Höchberg; Otto Theodor Weschenfelder, Würzburg, both of Germany

[73] Assignee: Koenig & Bauer-Albert Akiengesellschaft, Wurzburg, Germany

[21] Appl. No.: 09/068,121

[22] PCT Filed: Nov. 7, 1996

[86] PCT No.: PCT/DE96/02127

§ 371 Date: May 7, 1998

§ 102(e) Date: May 7, 1998

[87] PCT Pub. No.: WO97/17201

PCT Pub. Date: May 15, 1997

[30] Foreign Application Priority Data

Nov. 8, 1995 [DE] Germany ..... 195 41 579

[51] Int. Cl.[7] ..... B41F 13/58

[52] U.S. Cl. ..... 270/52.17; 270/52.07; 270/52.09; 270/52.12; 270/52.19; 270/41; 270/5.01; 493/357

[58] Field of Search ..... 270/5.01, 5.03, 270/32, 41, 52.07, 52.08, 52.09, 52.12, 52.19, 52.14, 52.17; 493/357, 360, 370, 435

[56] References Cited

U.S. PATENT DOCUMENTS

| | | | |
|---|---|---|---|
| 1,830,416 | 11/1931 | Wood . | |
| 2,092,977 | 9/1937 | Kaster . | |
| 2,361,140 | 10/1944 | Wolf | 270/5.01 |
| 4,063,505 | 12/1977 | Sasamoto et al. | 101/228 |
| 4,279,409 | 7/1981 | Pemberton | 270/41 |
| 5,469,788 | 11/1995 | Michalik . | |

FOREIGN PATENT DOCUMENTS

| | | |
|---|---|---|
| 4319806 | 1/1995 | Germany . |
| 437858 | 11/1935 | United Kingdom . |

*Primary Examiner*—Christopher P. Ellis
*Assistant Examiner*—Patrick Mackey
*Attorney, Agent, or Firm*—Jones, Tullar & Cooper PC

[57] ABSTRACT

A device is provided for the production of multi-layered longitudinally folded newspaper products with a tabloid section having a variable number of pages in one layer of the newspaper product. An additional longitudinal separating device is placed upstream, in the direction of the travel of the web, of the longitudinal former.

3 Claims, 3 Drawing Sheets

PROCESS AND DEVICE FOR PRODUCING MULTI-LAYERED NEWSPAPER PRODUCTS WITH A TABLOID SECTION

FIELD OF INVENTION

The present invention relates to a method and to a device for producing multi-layered, for example four-layered, newspaper products with a tabloid section inserted into a newspaper product. At least one longitudinal former is used to produce the multi-layered newspaper products. A number of paper webs can be varied and added to the one or more webs provided to the longitudinal former.

DESCRIPTION OF THE PRIOR ART

With single, i.e. collected, production and using, for example two longitudinal formers, it is known to manufacture printed products which consist of three separate newspaper sections and a separate tabloid section. In this case, the thickness of the tabloid section is determined by the thickness of the newspaper section which is guided over the same longitudinal former, and vice versa. A device for manufacturing such a printed product is disclosed in DE 43 19 806 A1.

U.S. Pat. No. 2,092,977 describes a device and a method for producing multi-layered newspaper products with an inserted tabloid section. Here, all successive products have a tabloid section, since one web is cut completely into two halves by means of a cutting device.

U.S. Pat. No. 2,361,140 and GB-A-437 858 describes longitudinal formers with associated longitudinal cutting devices.

SUMMARY OF THE INVENTION

It is the object of the present invention to provide a method and a device for producing multi-layered newspaper with so-called tabloid sections.

In accordance with the invention, this object is attained by utilization of at least one longitudinal former. A number of paper webs, which number is variable, is admixed to the one or more webs that are provided with a longitudinal separation cut and which are fed to the one longitudinal former.

The advantages which can be achieved with the present invention reside in particular in that the number of pages of the tabloid section enclosed in a layer of a longitudinally folded newspaper section can be varied. In this case, the product combined in this way as a whole has the same number of pages as one layer of a longitudinally folded newspaper product. Because of its half format, a tabloid section or magazine section has double the number of pages in comparison with a newspaper section of the same thickness and size.

BRIEF DESCRIPTION OF THE DRAWINGS

A preferred embodiment of the present invention is represented in the drawings in several working positions and will be described in greater detail in what follows.

Shown are in.

DESCRIPTION OF THE PREFERRED EMBODIMENT

Figure 1:
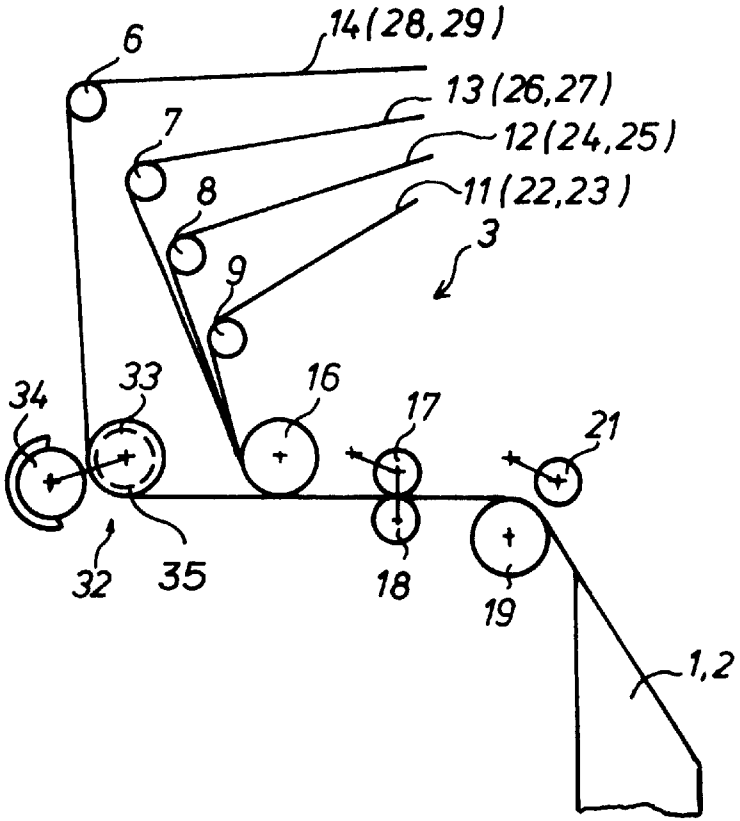
FIG. 1, a schematic side elevation view of a folding device superstructure with a device in accordance with the present invention in a first paper web guide.

A paper guide, draw-in and longitudinal cutting device, generally at 3 in FIG. 1 is arranged in a folding device superstructure, and is placed upstream of two known longitudinal formers 1, 2. This device 3, known from DE 43 19 806 A1, consists of paper guide rollers 6, 7, 8, 9, disposed obliquely above each other and at different levels, for guiding, for example four, paper webs 11, 12, 13, 14 of 1/1 width. The paper webs 11 to 14 run over a former pre-inlet roller 16, over drawing rollers 17, which can be placed against a drawing roller 18, and a former inlet roller 19, against which a longitudinal cutting device 21 operates. In this way, the paper webs 11 to 14 of 1/1 width are longitudinally separated into paper webs 22 to 29 of ½ width by means of the longitudinal cutting device 21 which accomplishes a full longitudinal cut. In accordance with the present invention, on the side of the former pre-inlet roller 16 remote from the longitudinal former, and at approximately the same level as the former pre-inlet roller 16, an additional longitudinal separating device 32 is located behind the first longitudinal former 1. This longitudinal separating device 32 consists of a former pre-inlet roller 33 with a cutting groove 35 and a longitudinal separating cutter 34 which is configured as a skip slitter, and which can be placed against the former pre-inlet roller 33. The longitudinal separating cutter or skip slitter 34 has a discontinuous cutting edge on its circumference extending over slightly more than 180° around the circumference of the rotating longitudinal separating cutter 34 and makes a discontinuous or alternating longitudinally spaced slits or cuts of a length slightly greater, for example 16 mm greater than the length of a side of a signature. The cylinders, or rollers 6 to 9, 16 to 19 and 33, respectively extend, separated or not separated, over the entire width of the 1/1 paper webs 11 to 14.

Figure 2:
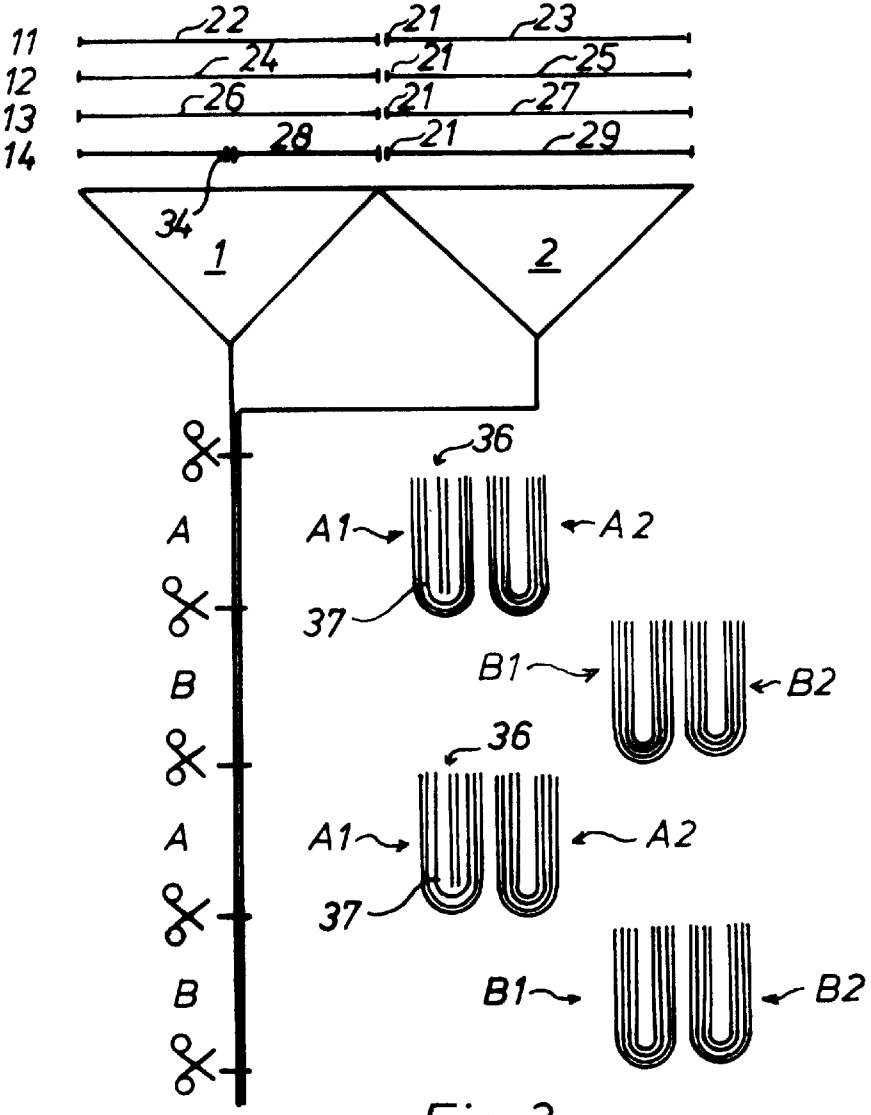
FIG. 2, a schematic front view of the longitudinal formers in accordance with FIG. 1, showing the course of the longitudinal cuts of the paper webs upstream of the former inlet, as well as the representation of the longitudinally folded products, as well as their cross sections following a first as well as a second transverse cutting process without a paper guidance, draw-in and longitudinal cutting device.

In connection with a first paper web guidance arrangement as seen in FIGS. 1 and 2, one of the paper webs 14 of 1/1 width is initially guided over the additional former pre-inlet roller 33 of the longitudinal separating device 32 and is then subsequently conducted, together with the other 1/1 webs 13, 12, 11, over the former pre-inlet roller 16 to the longitudinal cutting device 21 acting on the former inlet roller 19. The longitudinal cutting device 21 longitudinally separates all of all the paper webs 11 to 14 in the center. In the process, the paper webs of ½ width 22 to 29 as seen in FIG. 2 are created, wherein the paper web 28 of ½ width possibly has already been provided with a discontinuous or alternating cut, i.e. a slit, which will be described in what follows and which, as seen in FIG. 2, is not aligned with the center cuts made by the longitudinal cutting device 21. The following four-layered, longitudinally folded product is created in the course of the production of a longitudinally folded folding product of two cutting lengths A, B collected during transverse cutting, all as depicted in FIG. 2. In the course of the first cutting length A, a combined product A1 is created via the first longitudinal former 1, which consists of a first eight page tabloid section 36 and a second twelve page longitudinally folded newspaper section 37 surrounding the tabloid section 36. In the process, the longitudinal separating cutter or skip slitter 34 of the longitudinal separating device 32 is operated, so that the paper web 28 of ½ width is longitudinally separated into two paper webs of ¼ width. A longitudinally folded 16 page newspaper section A2 is created by the second longitudinal former 2 in the first cutting length A. In a second cutting length B, respectively one 16 page longitudinally folded newspaper section B1, or B2 is created by each of the first longitudinal former 1 and the second longitudinal former 2, while the longitudinal separation cutting device 32 is not active. Following collection on a collection cylinder, which is not specifically shown, of the folding apparatus, a four-layered folding product A1, A2, B1, B2 is generated. This four-layered product consists of a combined eight page tabloid and twelve page newspaper section A1 and of three, respectively longitudinally folded 16 page newspaper sections A2, B1, B2. A cutting length A or B is created in the course of the running of the machine in a time period between the transverse cutting processes by means of the transverse cutting device, not represented (FIGS. 1 and 2).

Figure 4:
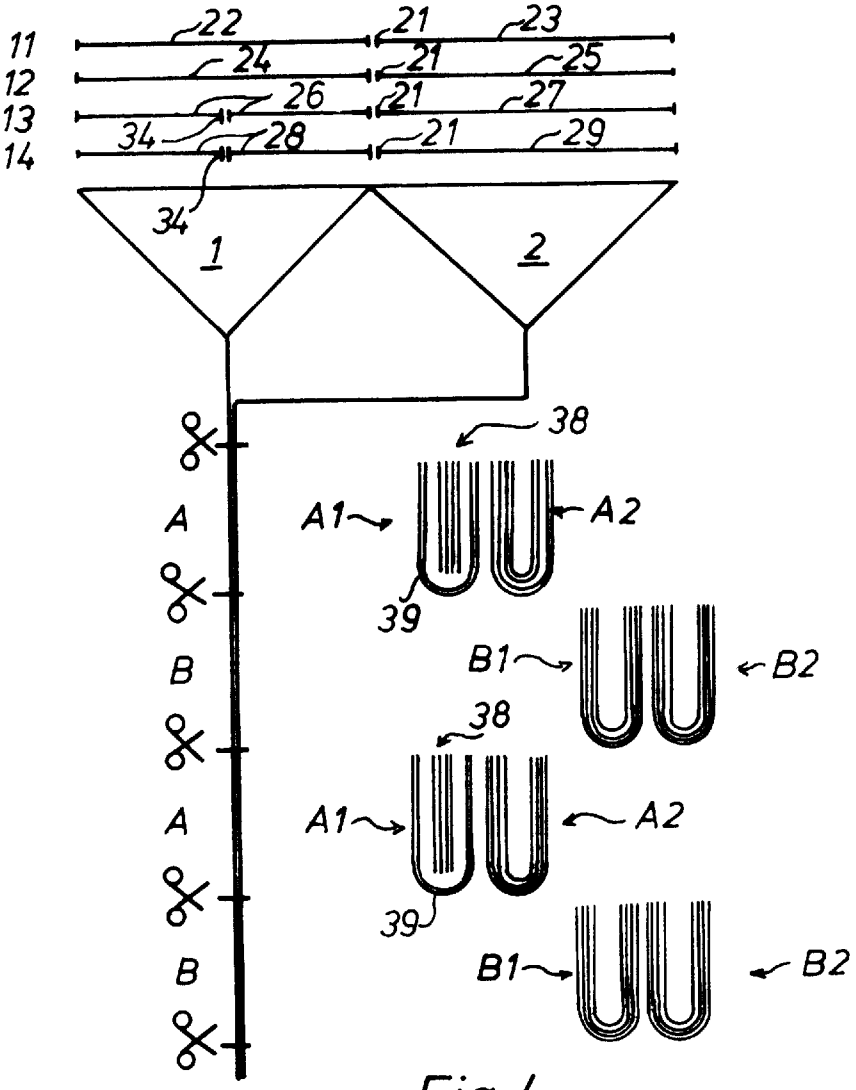
FIG. 4, the schematic front view of the longitudinal formers in accordance with FIG. 3, showing the course of the longitudinal cuts of the paper webs at the former inlet, as well as the representation of the longitudinally folded products as well as their cross sections following a first as well as a second transverse cutting process without a paper guidance, draw-in and longitudinal cutting device.
Figure 3:
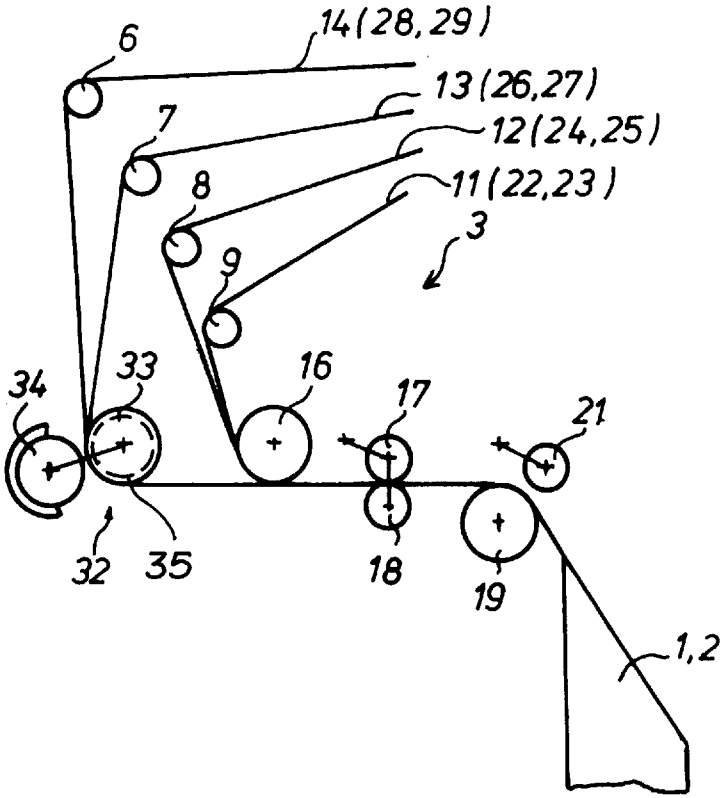
FIG. 3, a schematic side elevation view of the folding device superstructure with the device in accordance with the present invention in a second paper web guide.

Referring now to FIGS. 3 and 4, a second paper web guidance arrangement is shown in which two paper webs 14, 13 of 1/1 width are initially guided over the additional former pre-inlet roller 33 of the longitudinal separating device 32. Thereafter, the paper webs 14, 13, together with the paper webs 12, 11 of 1/1 width are guided over the former pre-inlet roller 15, and are cut into paper webs 22 to 29 of ½ width by means of the longitudinal cutting device 21. Again, as seen in FIG. 4, the spaced slits 13 are formed in the paper webs 14 and 13 by the skip slitter 34 of the longitudinal separating device 32 offset by one fourth of the web total width from the cuts subsequently formed in all of the paper webs 11–14 by the longitudinal cutting device 21. In the course of a collection production with the cutting length A, B, the following four-layer product is created:

In the course of the first cutting length A, as seen in FIG. 4 a combined product A1 is created by the first longitudinal former 1, which product A1 consists of a first sixteen page tabloid section 38 and a second eight page longitudinally folded newspaper section 39, which surrounds the tabloid section 38. In the course of producing the cutting length A, the longitudinal separating cutter or skip slitter 34 of the longitudinal separating device 32 is operated. In the process, a longitudinally folded 16 page newspaper section A2 is created by the second longitudinal former 2. Within a second cutting length B, respectively one 16 page longitudinally folded newspaper section B1, B2 is created by each of the longitudinal formers 1 and 2 analogously to the first paper web guide arrangement described in connection with FIG. 2. The longitudinal separating device 32 is not active here. Following collection, a four-layered folding product A1, A2, B1, B2 is generated. Thus, the resulting folded product consists of a combined product A1 with a 16 page tabloid section 38 and twelve page newspaper section 39 and of three, respectively longitudinally folded 16 pages newspaper sections A2, B1, B2 all as seen in FIGS. 3 and 4.

Figure 6:
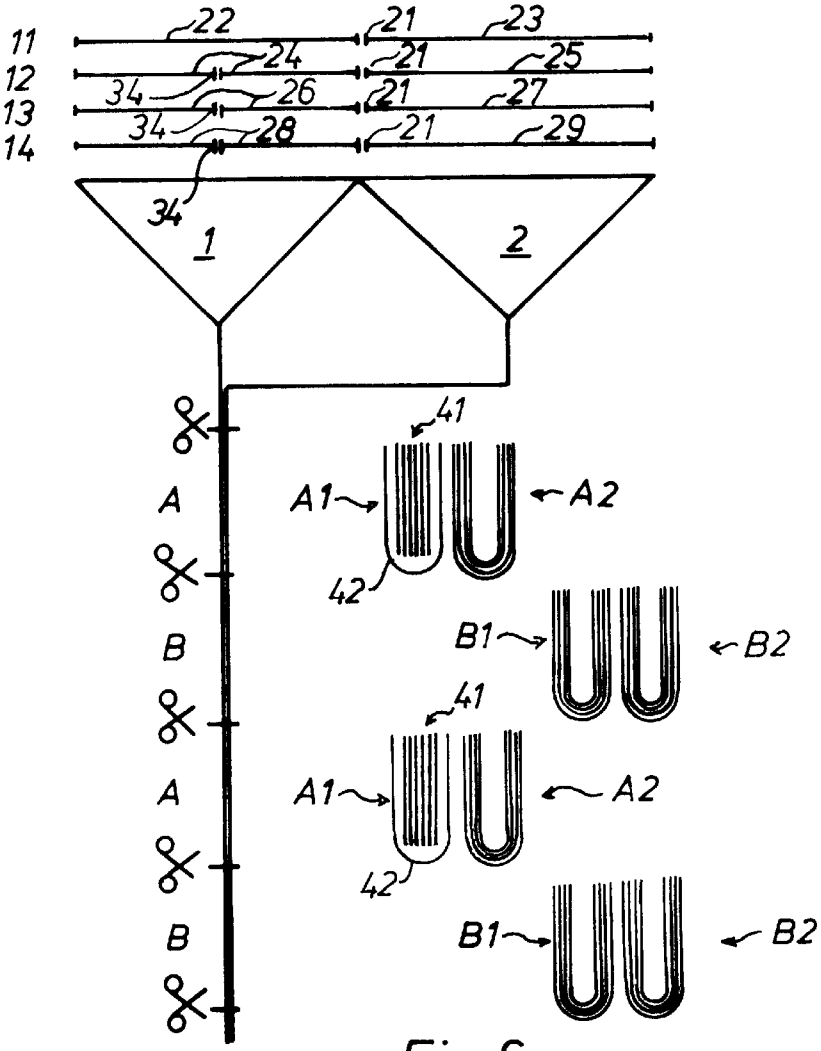
FIG. 6, the schematic front view of the longitudinal formers in accordance with FIG. 5, showing the course of the longitudinal cuts of the paper webs at the former inlet, as well as the representation of the longitudinally folded products as well as their cross sections following a first as well as a second transverse cutting process without a paper guidance, draw-in and longitudinal cutting device.
Figure 5:
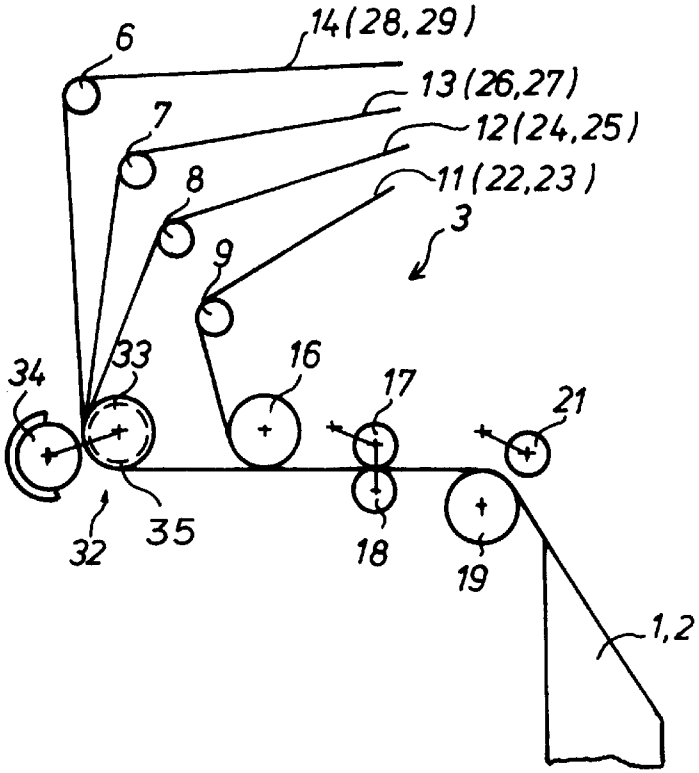
FIG. 5, a schematic side elevation view of the folding device superstructure with the device in accordance with the present invention in a third paper web guide.

In connection with a third paper web guidance arrangement illustrated in FIGS. 5 and 6, initially three paper webs 14, 13, 12 of 1/1 width are conducted through the additional former pre-inlet roller 33 of the longitudinal separating device 32. Subsequently, the skip slit paper webs 14, 13, 12, together with the paper web 11 of 1/1 width conducted over the former pre-inlet roller 16, are cut into paper webs 22 to 29 of ½ width by means of the longitudinal separation cutting device 21. As seen in FIG. 6, the three skip slit webs 14, 13, and 12 each have a slit 34 formed in them. During collection production with the cutting lengths A, B, the following four-layered product is created:

In the course of the first cutting length A, a combined product A1 is created, which consists of a first 24 page tabloid section 41 and a second four page longitudinally folded newspaper section 42, which surrounds the tabloid section 41. In the course of producing the cutting length A, the longitudinal separation cutter 34 or skip slitter of the longitudinal separating device 32 is operated. A longitudinally folded 16 page newspaper section A2 is concurrently created by the second longitudinal former 2. Within a second cutting length B, respectively one 16 page longitudinally folded newspaper section B1, B2 is created by each former 1 and 2 analogously to the previously described first and second paper web guidance, while the longitudinal separation cutting device 32 is not active here. Following collection, a four-layered folding product A1, A2, B1, B2 is produced. The number of the paper webs which can be conducted or mixed into the longitudinal separating device 32, and which have a so-called "skip slit", i.e. a longitudinal separating cut of the length of one side of the signatures, formed by the skip slitter 34 lies between, for example, one paper web 14 as depicted in FIG. 1, and three paper webs 14, 13, 12 (n−1) as shown in FIG. 5, wherein the total number n of the paper webs 14 to 11 is equal to four. The position of the paper webs 11 to 14, which are located one above the other, such as is represented in FIGS. 2, 4 and 6, corresponds to the position of the paper webs 11 to 14 between the longitudinal formers 1, 2 and the former inlet roller 19 in accordance with FIGS. 1, 3 and 5.

If an additional longitudinal separating device 32 were also to be assigned to the second longitudinal former 2, the longitudinally folded products A2 or B2 could also be provided with a tabloid section with variable numbers of pages.

Furthermore, by using a circular cutter in place of a longitudinal separating cutter or skip slitter 34 in the longitudinal separating device 32, it is also possible to provide each newspaper section A1, B1 with a tabloid section.

This device can of course also be employed in connection with machines with two cutting lengths on the circumference, which have only one longitudinal former. In this case a newspaper section and a newspaper section with an inserted tabloid section are alternatingly produced.

While a preferred embodiment of a device for producing multi-layered newspaper products with a tabloid section, and the method of operation have been described fully and completely hereinabove, it will be apparent to one of skill in the art that a number of changes in, for example, the type of printing press used, the type of folder used, the drive for the formers and the like could be made without departing from the true spirit and scope of the present invention which is accordingly to be limited only by the following claims.

What is claimed is:

1. A method for producing multi-layered newspaper products including an interior tabloid section including:

providing at least one longitudinal former;

providing at least one longitudinal separating device upstream in a direction of travel of a paper web from said at least one longitudinal former;

providing a longitudinal skip slitter and a cooperating former pre-inlet roller in said at least one longitudinal separating device;

directing a plurality of paper webs to said longitudinal former;

directing at least one of said plurality of paper webs, which at least one of said plurality of paper webs will form said interior tabloid section, to said longitudinal separating device prior to directing said plurality of paper webs to said longitudinal former:

forming discontinuous longitudinally extending slits in said interior tabloid section forming at least one of said plurality of paper webs in said longitudinal separating device, each of said longitudinally extending slits being slightly greater than a length of a signature to be formed using said plurality of paper webs;

combining said at least one of said plurality of paper webs provided with said discontinuous longitudinally extending slits with said plurality of paper webs prior to said longitudinal former;

longitudinally folding said plurality of paper webs in said at least one longitudinal former; and transversely cutting said longitudinally folded paper webs into a plurality of signatures, said interior tabloid section forming at least one of said plurality of paper webs provided with said discontinuous longitudinally extending slits forming said interior tabloid section in a multi-layered newspaper product produced using said signatures formed by said at least one longitudinal former.

2. A device for producing multi-layered newspaper products with an interior tabloid section from a plurality of paper webs, said device comprising:

at least one longitudinal former; and at least one longitudinal separating device situated upstream, in a direction of travel of said plurality of paper webs from said at least one longitudinal former, said at least one longitudinal separating device being positioned to receive at least one of said plurality of paper webs which form said interior tabloid section, and including a former pre-inlet roller and a cooperating longitudinal separating cutter, said at least one longitudinal separating cutter having a discontinuous cutting edge, a length of said discontinuous cutting edge being slightly greater than a length of a side of a signature formed and cut by said at least one longitudinal former.

3. The method for producing multi-layered newspaper products including an interior tabloid section in accordance with claim 1 further including bringing a lowermost one of said at least one of said plurality of paper webs having said discontinuous longitudinal slits into direct contact with said at least one longitudinal former.

* * * * *